US008857772B1

(12) United States Patent
Weldon

(10) Patent No.: US 8,857,772 B1
(45) Date of Patent: Oct. 14, 2014

(54) BAG HOLDER

(71) Applicant: Peter Marvin Weldon, Bartow, FL (US)

(72) Inventor: Peter Marvin Weldon, Bartow, FL (US)

( * ) Notice: Subject to any disclaimer, the term of this patent is extended or adjusted under 35 U.S.C. 154(b) by 0 days.

(21) Appl. No.: 13/867,064

(22) Filed: Apr. 20, 2013

(51) Int. Cl.
*A63B 55/04* (2006.01)

(52) U.S. Cl.
USPC ..... 248/97; 248/95; 248/99

(58) Field of Classification Search
CPC ..... B65B 67/12
USPC ..... 248/99, 95
See application file for complete search history.

(56) References Cited

U.S. PATENT DOCUMENTS

| | | | | |
|---|---|---|---|---|
| 261,458 | A | 7/1882 | Holekamp | |
| 575,902 | A | 1/1897 | Nicholas | |
| 1,542,164 | A | 4/1923 | Nelson | |
| 3,095,172 | A * | 6/1963 | Dwyer | 248/97 |
| D216,438 | S | 1/1970 | Gay | |
| D223,682 | S * | 5/1972 | Aldape | |
| D245,391 | S * | 8/1977 | Thorpe | D34/6 |
| D264,650 | S | 6/1982 | Adamson | |
| 4,623,111 | A | 11/1986 | Prader | |
| 4,759,518 | A | 7/1988 | Yardas | |
| D308,271 | S | 5/1990 | Vreeken | |
| D341,688 | S | 11/1993 | Binkley et al. | |
| D345,242 | S | 3/1994 | Bunn | |
| 5,393,023 | A | 2/1995 | Callan | |
| 5,564,660 | A * | 10/1996 | Gyor | 248/97 |
| D389,632 | S | 1/1998 | Reddin | |
| D428,544 | S | 7/2000 | Moffitt et al. | |
| 6,971,611 | B2 * | 12/2005 | Folkmar | 248/95 |
| 6,994,301 | B1 | 2/2006 | Fox | |
| 7,284,732 | B1 | 10/2007 | Lopa | |
| 8,091,840 | B1 | 1/2012 | Ortiz-Torres | |
| 2006/0175475 | A1 | 8/2006 | Desantis | |
| 2007/0181753 | A1 | 8/2007 | Herlands | |

* cited by examiner

*Primary Examiner* — Amy J Sterling
(74) *Attorney, Agent, or Firm* — Lonnie Drayer

(57) ABSTRACT

A bag holder that has a lower frame member with a curved surface that substantially conforms to the curvature of a first circle. An upper frame member has a curved surface that substantially conforms to the curvature of a second circle, with the radii of the circles being substantially the same. First, second and third vertical support members are fixed to the upper and lower frame members. A centermost vertical support member is substantially equidistant from the other vertical support members. An elastomeric pad extends along the upper frame member and wraps around the upper frame member.

17 Claims, 12 Drawing Sheets

BAG HOLDER

FIELD OF THE INVENTION

The present invention relates generally to a device for holding a bag open and more specifically to a device for holding a plastic bag open while items such as leaves, cut grass or other refuse is loaded into the bag.

BACKGROUND OF THE INVENTION

Flexible plastic bags are commonly used for packaging cut grass, leaves, debris and other unwanted materials. Cleaning tasks are facilitated by maintaining the plastic bags widely open; protecting the container or bag from puncturing or tearing and facilitating the movement of the plastic bags during and after the collection process. It is desirable to provide a device for supporting a plastic bag in an open condition while it is being filled. Accordingly various bag holders have been proposed.

DISCUSSION OF THE PRIOR ART

There have been efforts to provide a suitable device for holding a bag open for at least one hundred and twenty years as evidenced by U.S. Pat. No. 261,458 A issued in 1882. U.S. Pat. No. 575,902 A issued in 1897 disclosed a device for holding open a sack, such as a grain sack, wherein the device has a curved main bar with three legs attached thereto in a foldable and lockable manner.

U.S. Pat. No. 1,542,164 A discloses a collapsible holder for open mouth plastic bags having integral loop handles.

U.S. Pat. No. 4,759,518 A discloses a trash bag holder comprising a stand supporting a textured circular support ring over which the lip of a trash bag can be folded. A resilient tube-shaped arcuate clamp engages the ring with a layer of the bag there between to hold the bag onto the ring.

U.S. Pat. No. 5,393,023 A discloses a collapsible bag holder for a flexible bag comprising a lower support member, an upper support member and a plurality of resiliently flexible struts. The struts are connected to the support members in a pivotable manner.

U.S. Pat. No. 6,994,301 B1 discloses a collapsible support frame for a leaf bag. The device has two side members attached to each other by at least one hinge and a retention ring that secures an open bag to the support frame.

U.S. Pat. No. 7,284,732 B1 discloses a bag holder frame with a relatively conic-like shape in cross section with a top orifice that is smaller than the bottom orifice. The device incorporates means for fastening a plastic bag to or about the top of the frame.

U.S. Pat. No. 8,091,840 B1 discloses a device for holding bags open capable of being assembled in a variety of ways to accommodate bags of various sizes.

US 2006/0175475 A1 discloses a device for holding a plastic bag. The device has a base member with at least two parallel horizontally disposed support members. A pair of upstanding legs is connected closely to the base member closely adjacent a back portion. A brace is disposed substantially horizontally and connected near a second end of the legs. There are at least two parallel horizontally disposed arm members connected at a first end to the legs and the brace. Further, there is a means for attaching a plastic bag to at least one of the arms and the legs.

US 2007/0181753 A1 discloses a trash bag holder that includes an opening frame that has two pegs or hooks at a height and spacing corresponding to the upper band of a selected drawstring plastic trash bag. In certain embodiments the trash bag holder includes a vertical support and a horizontal base, wherein the vertical support is attached to both the opening frame and the base.

Various ornamental designs for bag holders are disclosed in the prior art, for example in: U.S. Des. 216,438 S; U.S. Des. 264,650 S; U.S. Des. 308,271 S; U.S. Des. 341,388 S; U.S. Des. 345,242 S; U.S. Des. 389,632 S; and U.S. Des. 428,544 S.

SUMMARY OF THE INVENTION

There is provided in accordance with the present invention a bag holder that has a lower frame member with a curved surface that substantially conforms to the curvature of a first circle having a first radius. An upper frame member has a curved surface that substantially conforms to the curvature of a second circle having a second radius that is substantially the same as the first radius. The curved surface of the upper frame member has first and second ends with the curved surface of the upper frame member having an arc with ends at the first and second ends of curved surface of the upper frame member that is more than 180 degrees of the second circle's curvature. First, second and third vertical support members are fixed to the curved surfaces of both the upper and lower frame members with the upper and lower frame members spaced apart from one another. The second vertical support member is located substantially equidistant from the first and third vertical support members as measured along the curved surfaces of both the lower and upper frame members. The curved surface of the lower frame member has an arc with ends at the first and third vertical support members that is not more than 180 degrees of the first circle's curvature, and the curved surface of the upper frame member has an arc with ends at the first and third vertical support members that is not more than 180 degrees of the second circle's curvature.

DETAILED DESCRIPTION OF THE INVENTION

Figure 1A:
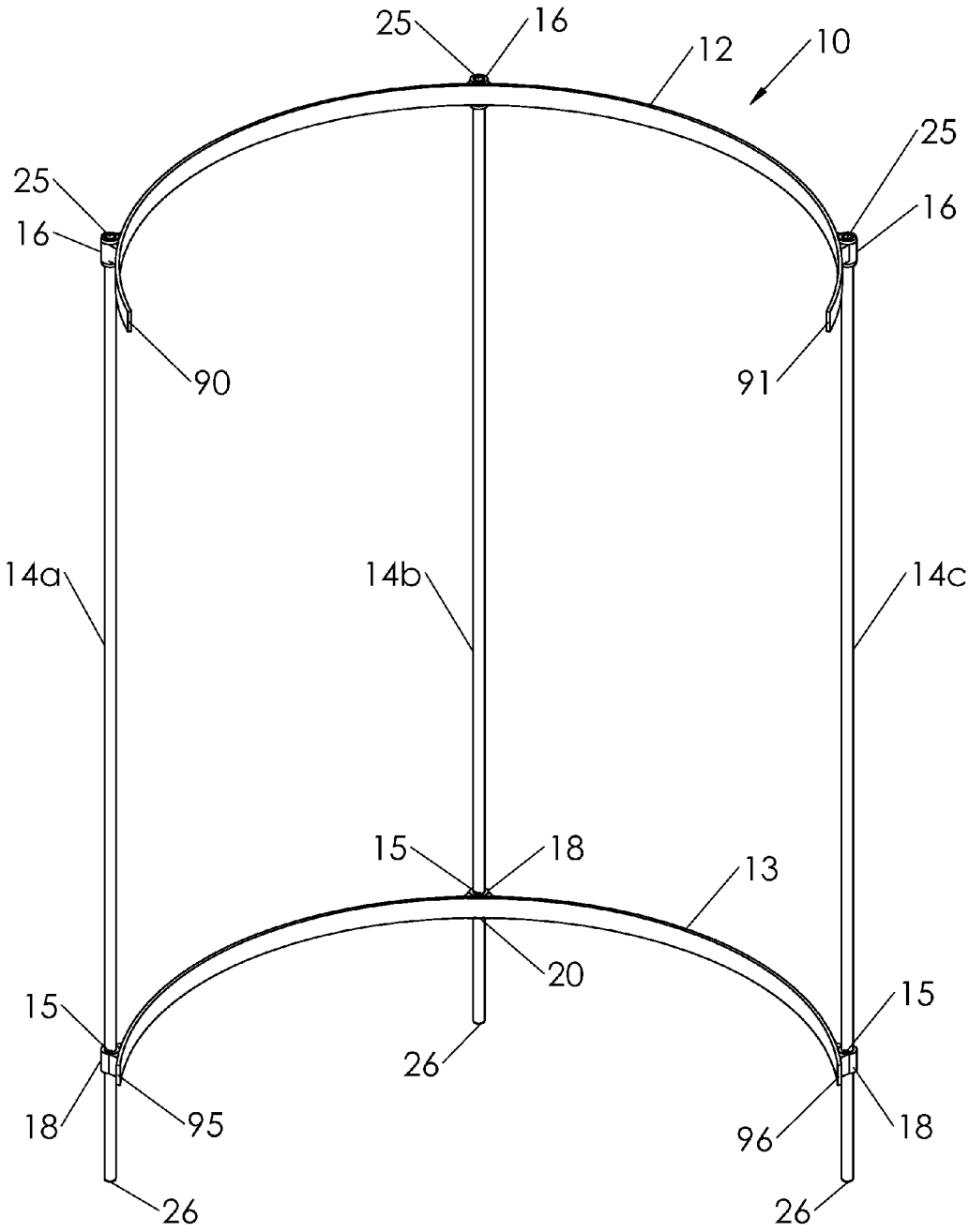
FIG. 1A is a front perspective view of a bag holder according to a first embodiment of the present invention.
Figure 1B:
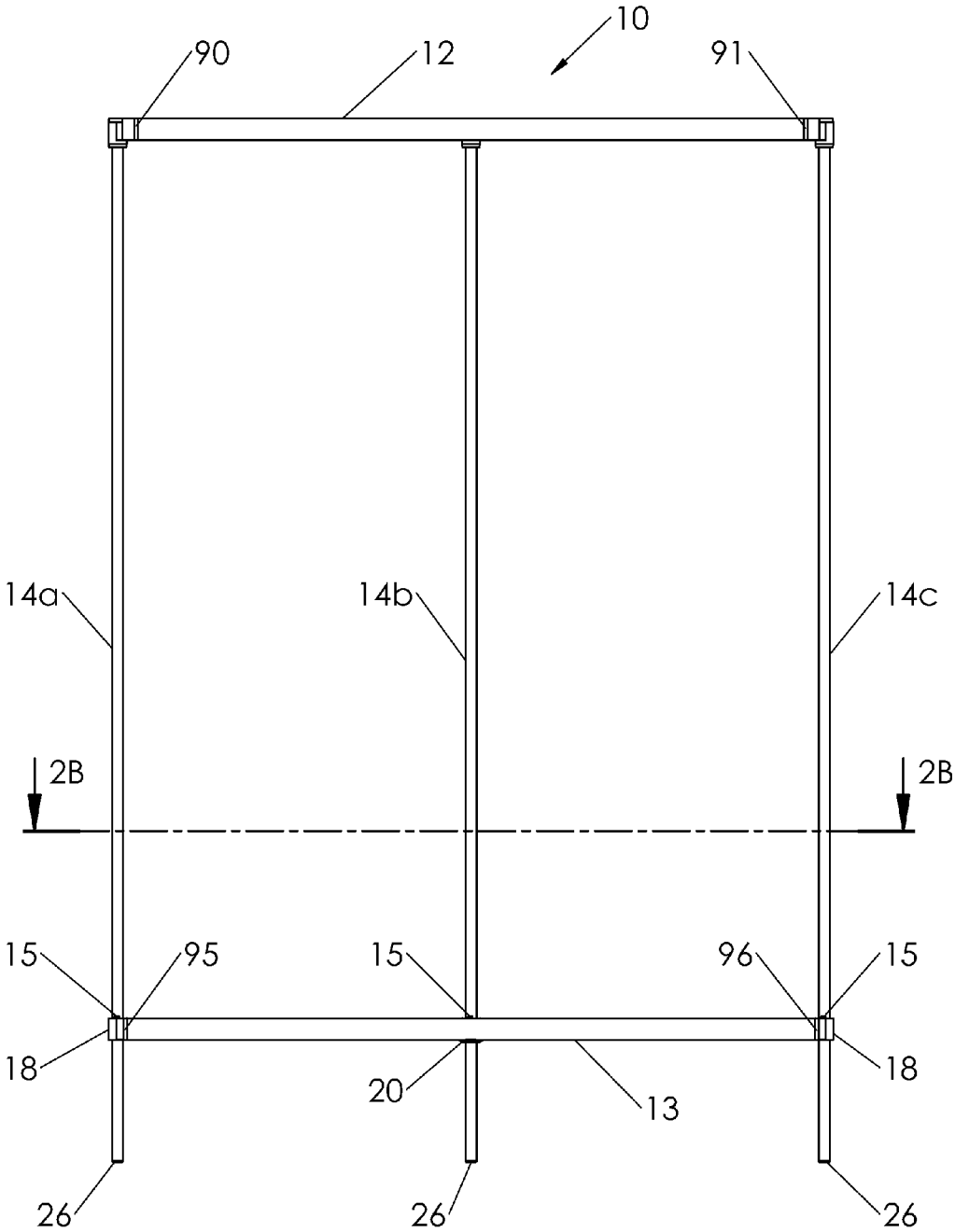
FIG. 1B is a front elevation view of the bag holder of FIG. 1A.
Figure 2A:
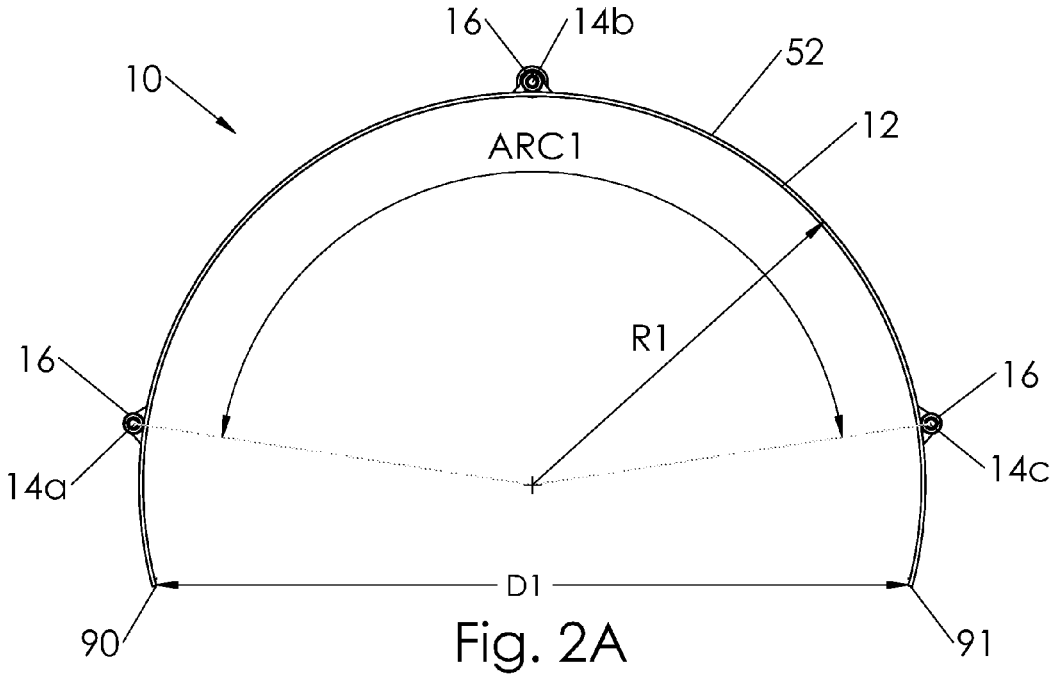
FIG. 2A is a top view looking down on the bag holder of FIG. 1.
Figure 2B:
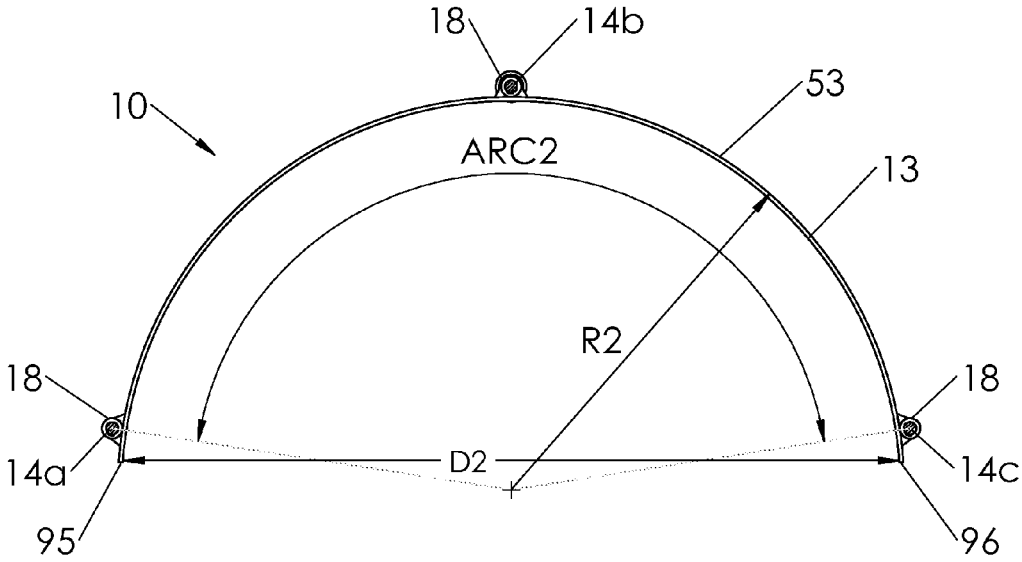
FIG. 2B is a section view taken at line 2B-2B of FIG. 1B looking downward at the bag holder of FIG. 1A.

A first exemplary embodiment of a bag holder 10 of the present invention is shown in FIGS. 1A-2B. FIG. 1A is a front perspective view and FIG. 1B is a front elevation view of the bag holder 10. FIG. 2A is a top view looking down on the bag holder 10 and FIG. 2B is a section view taken at line 2B-2B. Exemplary components that are common to the bag holders of the first four embodiments 10, 40, 50, and 60 of bag holders of the present invention are shown in FIGS. 3A-3E.

As used herein and in the claims terms relating to relative locations of components of a bag holder of the present invention are understood to relate to a bag holder in its operative position as shown in FIGS. 1A, 1B, 5, 6, 7, and 9-13.

A bag holder 10 has an upper frame member 12, a lower frame member 13, and first, second and third vertical support members 14*a*, 14*b*, and 14*c*. The upper frame member 12 may comprise for example a steel bar having dimensions of about ¾ inch wide by about ⅛ inch thick by about 4 feet long as shown in a starting configuration in FIG. 3A. The lower frame member 13 may comprise for example a steel bar having dimensions of about ¾ inch wide by ⅛ inch thick by 3 feet long as shown in a starting configuration in FIG. 3B. The three vertical support members 14*a*, 14*b*, and 14*c* may each comprise for example a steel rod having a diameter of about ⅜ inch and a length of about 3 feet as shown in a starting configuration in FIG. 3C. It is understood that these dimensions are for an exemplary bag holder intended for use with a large plastic trash bag having a capacity for example of about 39 gallons which is suitable for packaging cut grass, leaves, debris and other unwanted materials. It is understood that the dimensions of the upper and lower frame members and the vertical support members can be varied to accommodate bags of various sizes including plastic bags used indoors in kitchens or other locations. It is further understood that while the exemplary prototype bag holder used steel components that other suitable materials such as other metals and plastics selected in accordance with good engineering practices may be used in the practice of the present invention.

Figure 3A:
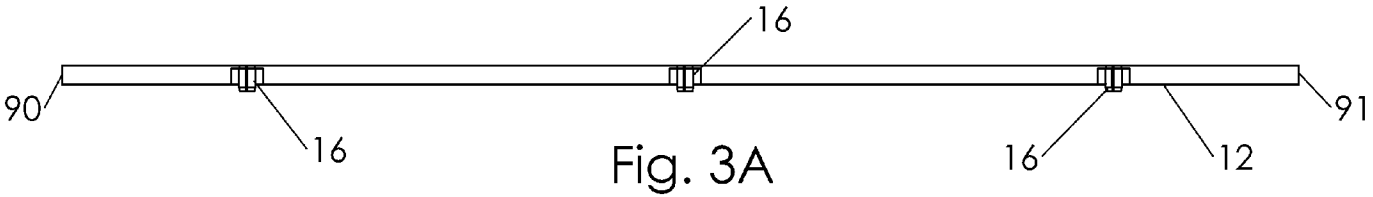
FIGS. 3A-3E show components of a bag holder of the present invention.
Figure 4A:
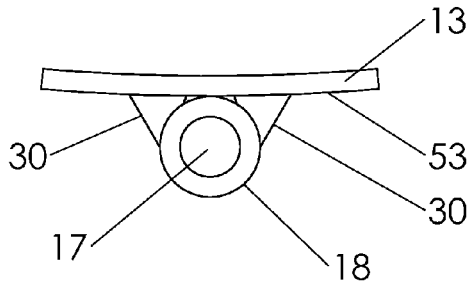
FIGS. 4A-4D show methods of fixing components of the present invention to one another.
Figure 4B:
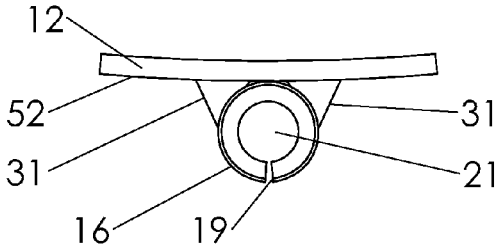

In the first exemplary embodiment 10 the upper frame member 12 is provided with three attachment fixtures 16 for fixing the three vertical support members 14*a*, 14*b*, and 14*c* to the upper frame member in a manner illustrated for example in FIG. 4B. In a prototype of the first exemplary embodiment the attachment fixtures were steel tension roll pins 16 having dimensions of about ⅝ inch outside diameter and a length of about 1 inch, provided with a gap 19 that allowed the roll pins to have somewhat of a clamping force on a vertical support member extending through a passage 21 in the roll pin. In the exemplary prototype bag holder the rolls pins were each secured to a surface 52 of the upper frame member 12 by welds 31. With reference to FIG. 3A one of the attachment fixtures 16 is fixed to the upper frame member 12 midway between the ends 90, 91 of the upper frame member, and the other two attachment fixtures are each fixed to the upper frame member 7 inches from each end 90, 91 of the upper frame member.

Figure 3B:
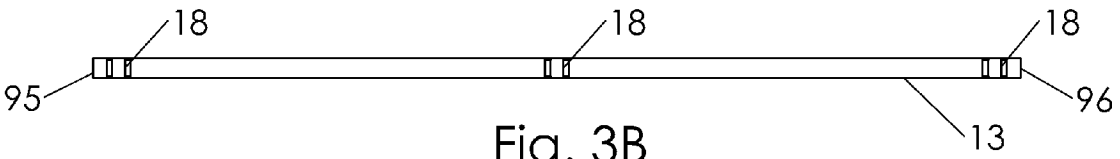

In the first exemplary embodiment 10 the lower frame member 13 is provided with three attachment fixtures 18 for fixing the three vertical support members 14*a*, 14*b*, and 14*c* to the lower frame member in a manner illustrated for example in FIG. 4A. In a prototype of the first exemplary embodiment the attachment fixtures were tubular steel spacers 18 having dimensions of about ½ inch outside diameter and a length of about ¾ inch intended to receive a vertical support member extending through a passage 17 in the tubular steel spacer. In the exemplary prototype bag holder the tubular steel spacers were each secured to the lower frame member 13 by welds 30. With reference to FIG. 3B one of the attachment fixtures 18 is fixed to the lower frame member 13 midway between the ends 95, 96 of the lower support member, and the other two attachment fixtures are each fixed to the lower frame member 1 inch from each longitudinal end 95, 96 of the lower frame member.

Figure 4C:
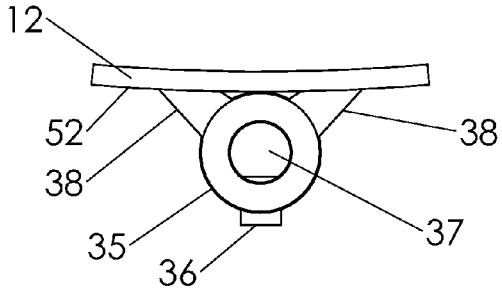
Figure 4D:
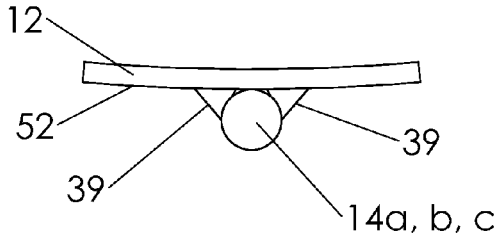

It is understood that the exemplary prototype bag holder 10 was fabricated using readily available materials and that the dimensions of the components used in the exemplary prototype may be varied and optimized in accordance with good engineering practices. For example the upper frame member could have tubular steel spacers used in place of the steel tension roll pins, and the lower frame member could have steel tension roll pins used in place of the tubular steel spacers. Alternatively, as shown in FIG. 4C a steel collar 35 provided with a set screw 36 could be attached to a surface 52 of the upper frame member 12 by welds 38 to receive a rod in a passage 37 in the steel collar and secure the rod in place with the set screw. It is understood that such an alternative attachment feature could be used with regards to the lower frame member. In another alternative shown in FIG. 4D a vertical support member 14*a, b, c* may be fixed directly to a surface 52 of a upper frame member 12 by welds 39. It is understood that such an alternative attachment feature could be used with regards to the lower frame member as well.

The upper frame member 12 is bent from the straight starting configuration shown in FIG. 3A into a curved configuration shown in FIGS. 1A and 2A such that the upper frame member has a radially inner curved surface and a radially outer curved surface 52. As best shown in FIG. 2A the radially outer curved surface 52 of the upper frame member 12 substantially conforms to a first circle's curvature, or at least a portion or segment of the first circle's curvature, the first circle having a radius R1. The lower frame member 13 is bent from the straight starting configuration shown in FIG. 3B into a curved configuration shown in FIGS. 1A and 2B such that the lower frame member has a radially inner curved surface and a radially outer curved surface 53. As best shown in FIG. 2B the radially outer curved surface 53 of the lower frame member 13 substantially conforms to a second circle's curvature, the second circle having a radius R2. Put another way the lower frame member 13 has a curved surface 53 that substantially conforms to a first circle's curvature, or at least a portion or segment of the second circle's curvature, the first circle having a radius R2; and the upper frame member 12 has a curved surface 52 that substantially conforms to a second circle's curvature, the second circle having a radius R2 that is substantially the same as the radius R1. It is preferred that the radii R1 and R2 are at least substantially the same. It is understood that the two radii are substantially the same if they do not differ in value by greater than about ten percent, but preferably the two radii do not differ in value by more than five percent. In the exemplary prototype bag holder the radii R1 and R2 are about 12 inches.

Figure 3C:
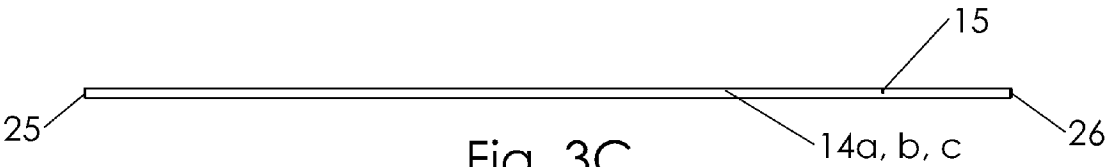

A bag holder 10 of the present invention is provided with first, second and third vertical support members 14*a*, 14*b*, 14*c* one of which is shown in a starting configuration in FIG. 3C. In the exemplary prototype the vertical support members are substantially identical to one another with circular cross sections and each has a first longitudinal end 25 and a second longitudinal end 26. In the exemplary prototype the vertical support members each have a length of about 3 feet with a stop 15 welded to the vertical support member at a distance of about 5 inches from the second end 26 to aid in proper location of the vertical support member with respect to the lower frame member 13 in a manner that will be explained below. Each of the vertical support members 14*a*, 14*b*, 14*c* is fixed to the curved surfaces, namely the radially outermost curved surfaces 52, 53 of both the upper 12 and lower 53 frame members with the upper and lower frame members spaced apart from one another as shown for example in FIGS. 1A and 1B. In the exemplary prototype bag holder 10 after the lower support member 13 had been formed into a curved configuration, as described in the preceding paragraph, the vertical support members 14*a*, 14*b*, 14*c* were each fixed to the lower frame member 13 by passing the second end 26 through a fixing member 18 until the stop 15 on the vertical support member was adjacent to an upper surface of the fixing member 18 such that the second end 26 of the vertical support member is spaced apart from the lower frame member as shown for example in FIGS. 1A and 1B. This feature of a bag holder 10 according to the first embodiment allows the vertical support members to be pushed into the earth to support the bag holder in a stable upright position when the bag holder is holding a plastic bag open for collecting cut grass, leaves, yard waste or other refuse. In the exemplary prototype bag holder it was found to be advantageous to place a push on washer 20 of the type shown for example in FIG. 3E onto the centermost vertical support member 14*b* such that the fixing member 18 is sandwiched between the stop 15 on the vertical support member and the push on washer 20. The exemplary push on washer 20 in FIG. 3E has a passage 20*a* surrounded by a flexible portion 20*b* that allows the push on washer to be pushed onto a shaft, such as the rod comprising a vertical support member 14*b*, but resists movement of the push washer after the push washer is disposed adjacent to the fixing member 18. In the exemplary prototype bag holder it was found not to be necessary to provide all of the vertical support members 14*a*, 14*b*, 14*c* with push on washers, but it is optional to do so. In the exemplary prototype bag holder 10 after the upper frame member 12 had been formed into a curved configuration, as described in the preceding paragraph, the vertical support members 14*a*, 14*b*, 14*c* were each fixed to the upper frame member 12 by inserting the first end 25 into a fixing member 16 until the first end of the vertical support member is adjacent to, that is to say vertically aligned with the upper frame member 12.

The centermost vertical support member 14*b* is located substantially equidistant from the other two vertical support members 14*a*, 14*c* as measured along the curved surfaces, that is to say the radially outermost curved surfaces 52, 53, of both the lower 13 and upper 12 frame members. Put another way lines connecting the vertical support member in FIGS. 2A and 2B would form an isosceles triangle having two equal included angles and two sides of equal length.

With reference to FIGS. 2A and 2B the curved surface, that is to say the radially outermost curved surface 52, of the upper frame member 12 has an arc ARC1 with ends at the first 14*a* and third 14*c* vertical support members that is not more than 180 degrees of the curvature of the circle having radius R1. The curved surface that is to say the radially outermost curved surface 53, of the lower frame member 13 has an arc ARC2 with ends at the first 14*a* and third 14*c* vertical support members that is not more than 180 degrees of the curvature of the circle having radius R2. In the exemplary prototype bag holder of FIG. 10 ARC1 and ARC2 are about 162 degrees of the circles having the radii R1 and R2.

With reference to FIGS. 2A and 2B the curved surface, that is to say the radially outermost curved surface 52, of the upper frame member 12 has an arc with ends at the first and second ends 90, 91 of the radially outer curved surface 52 of the upper frame member that is more than 180 degrees of the first circle's curvature and less than 270 degrees of the curvature of the circle having radius R1. With reference to FIGS. 2A and 2B the curved surface, that is to say the radially outermost curved surface 53, of the lower frame member 13 has an arc with ends at the first and second ends 95, 96 of the radially outer curved surface 53 of the lower frame member that is fewer degrees of the curvature of the circle having radius R2 than the arc of the upper frame member 12 between the ends 90, 91 of the radially outer curved surface 52 of the upper frame member has of the circle having radius R1. In the exemplary prototype bag holder of FIGS. 1A and 1B the curved surface, that is to say the radially outermost curved surface 52, of the upper frame member 12 has an arc with ends at the first and second ends 90, 91 of the radially outer curved surface 52 of the upper frame member that is about 210 degrees of the curvature of the circle having radius R1. In the exemplary prototype bag holder of FIGS. 1A and 1B the curved surface, that is to say the radially outermost curved surface 53, of the lower frame member 13 has an arc with ends at the first and second ends 95, 96 of the radially outer curved surface 53 of the lower frame member that is about 172 degrees of the curvature of the circle having radius R2. Because R1 and R2 are substantially the same it follows with reference to FIGS. 2A and 2B that a distance D1 between the ends 90, 91 of the upper frame member 12 is less than a distance D2 between the ends 95, 96 of the lower frame member 13. In the exemplary prototype bag holder 10 of FIGS. 1A and 1B the gap D1 in the upper frame member 12 was about 22 inches and the gap D2 in the lower frame member 13 was about 24 inches.

One of the most common ways of collecting cut grass, leaves or other refuse in a plastic bag is to place a bag into a plastic or metal trash container with the open end of the bag folded over around the rim of the trash container. Many metal and plastic trash containers have inside diameters that are widest at the top rim of the container and then taper to a smaller diameter at the bottom of the container. This configuration limits the volume of grass or leaves that can be placed in the plastic bag to less than the specified volume of the bag. When the plastic bag is "filled" with cut grass or leaves a person must pull on the bag to remove the bag from the metal or plastic trash container, which is made difficult by a partial vacuum formed between the bag and the interior surfaces of the trash container. The geometric configuration of a bag holder 10 of the present invention provides many advantages for a person using the new bag holder. An empty plastic bag may be fixed to the bag holder with the top of the bag open to receive cut grass, leaves or other refuse by folding over the open end of the bag around the upper frame member 12, leaving the closed end of the bag unrestricted so that more cut grass or leaves can be placed in the bag than when the same bag is in a metal or plastic trash container. When a person is satisfied with the amount of cut grass, leaves or other refuse in the bag the top portion of the bag can be unfolded from around the upper frame member and the bag can be simply pulled through the gap D1 in the upper frame member. The properties of the material and dimensions of the upper frame member 12 are preferably selected such that the portions of the upper frame member located between the first and third vertical support members 14*a*, 14*c* and the ends 90, 91 of the upper frame member are somewhat flexible and resilient so the plastic bag can be pulled through the gap D1 with less effort than is required to extract the same bag and bag contents from a metal or plastic trash container. If the portions of the vertical support members 14*a*, 14*b*, 14*c* that extend below the lower frame member 13 are inserted into the earth to give the bag holder added stability enabling the bag holder to remain in place better than a metal or plastic trash container when an empty plastic bag is installed on the bag holder or a full plastic bag is removed from the bag holder. The open construction of the new bag holder makes it comparatively light weight for easy handling and facilitates nesting of multiple bag holders for storage or shipping.

Figure 3D:
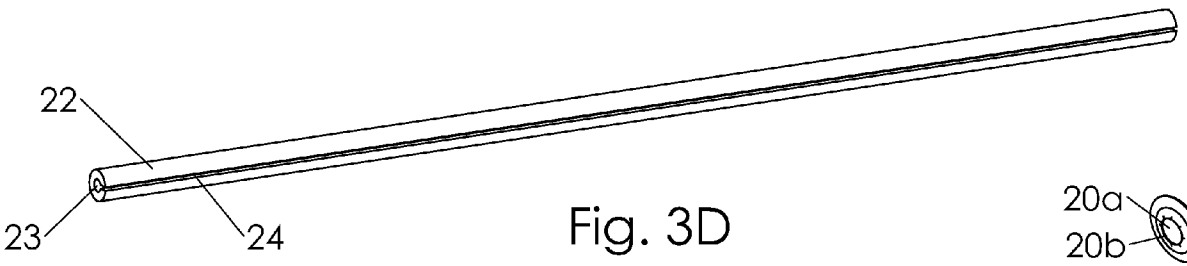
Figure 3E:
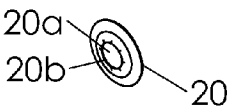
Figure 5:
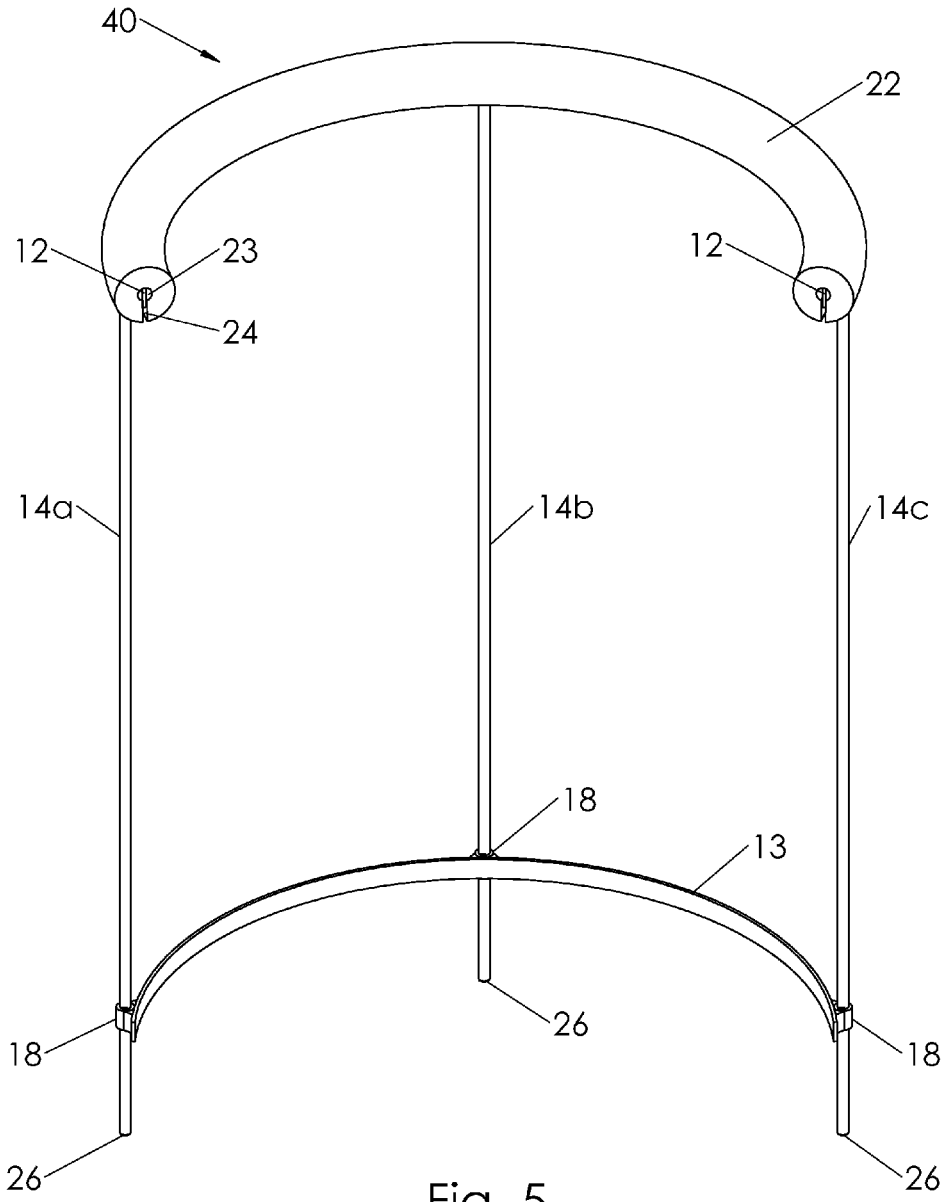
FIG. 5 is a front perspective view of a bag holder according to a second embodiment of the present invention.
Figure 6:
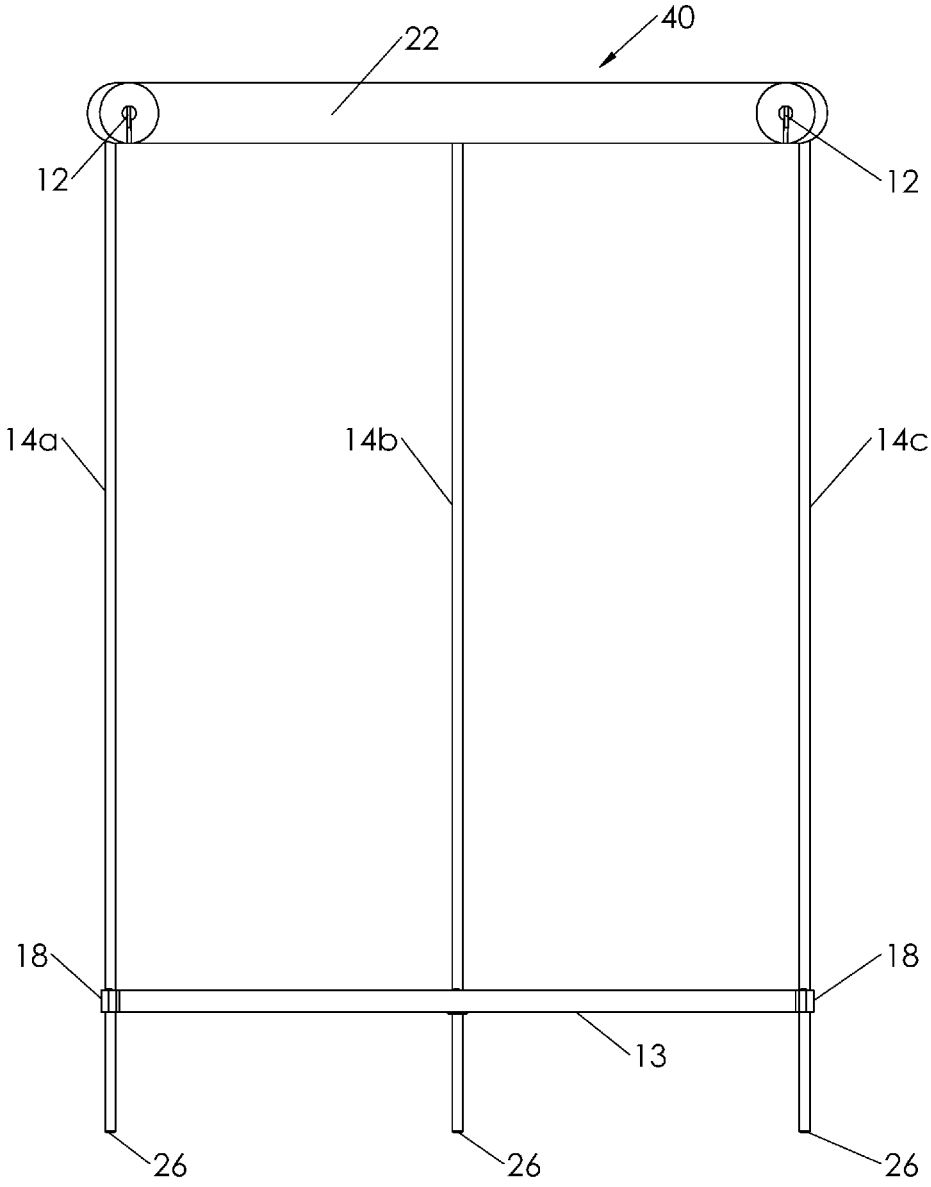
FIG. 6 is a front elevation view of the bag holder of FIG. 5.
Figure 7:
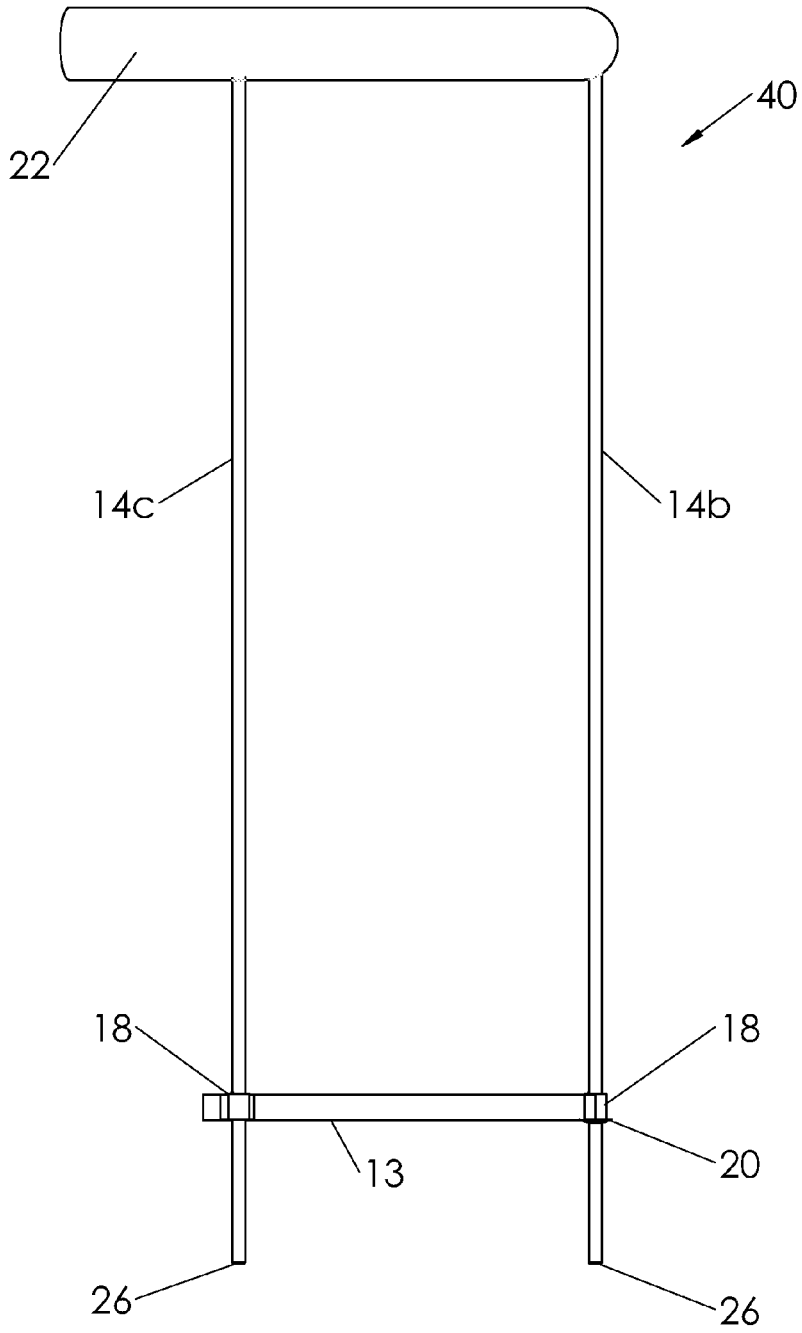
FIG. 7 is a side elevation view of the bag holder of FIG. 5.
Figure 8:
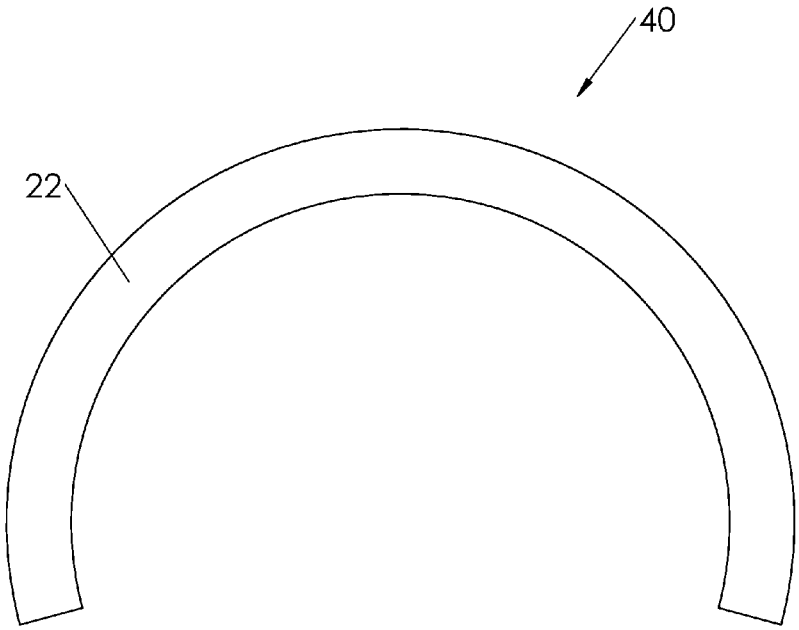
FIG. 8 is a top view looking down on the bag holder of FIG. 5.

A second embodiment of a bag holder 40 of the present invention is shown in FIGS. 5-8. FIG. 5 is a front perspective view of a bag holder 40 according to a second embodiment of the present invention. FIG. 6 is a front elevation view of the bag holder 40 of FIG. 5. FIG. 7 is a side elevation view of the bag holder 40 of FIG. 5. FIG. 8 is a top view looking down on the bag holder 40 of FIG. 5. The bag holder 40 of the second embodiment is identical to the bag holder 10 of the first embodiment including upper 12 and lower 13 frame members, three vertical support members 14*a*, 14*b* and 14*c* fixed to both the upper and lower frame members using for example fixing members 16 and 18. These components are dimensioned, configured and assembled as described above with regards to the first embodiment of the invention. However the second embodiment further comprises an elastomeric pad 22 that is fixed to the upper frame member 12. Preferably, as shown, the elastomeric pad 22 extends along the upper frame member 12 continuously between the first and second ends 90, 91 of the radially outer curved surface 52 of the upper frame member and wraps around the upper frame member. An exemplary elastomeric pad is shown in FIG. 3D in a starting configuration. An elastomeric pad used in an exemplary prototype bag holder according to the present invention was a length of a widely available elastomeric foam material sold for use in insulating a length of water pipe to impair the loss of heat from a pipe conducting hot water. The pipe insulating material has a passageway 23 extending longitudinally along the entire length of the insulating material and is slit 24 along the entire length of the insulating material to facilitate wrapping the insulating material around a water pipe. The edges of the slit 22 are commonly provided with adhesive strips to fasten the edges of the slit together to retain the insulating material in place around the water pipe. The elastomeric foam material used with the exemplary prototype of the second embodiment of the present invention had a passageway 23 with a diameter of about ½ to about ⅜ inch with the wall of elastomeric foam having a thickness of about ½ inch, and a length of about 4 feet which is the same as the length of the upper frame member 12. There are prior art bag holder devices that require one or more clips to be used to retain a plastic bag folded over a support member of the device, which requires effort by a person to install and remove the clips, and hopefully not misplace or damage the clips. The elastomeric pad 22 preferably has a surface that is not smooth for engaging a plastic bag folded around the elastomeric pad and upper frame member, but rather is uneven and rough enough to cause friction between the pad and the plastic bag to aid in maintaining the plastic bag in a desired operative position with regards to the bag holder to retain the plastic bag in substantially static contact with the bag holder with the bag open. An elastomeric foam pad without a smooth outer engagement surface meets these requirements at a reasonable cost. It is understood that if desired the elastomeric pad does not have to extend continuously along the entire length of the upper frame member and does not have to be folded around the upper frame member so long as the elastomeric pad, or pads, engage a plastic bag that is folded over the upper frame member.

Figure 9:
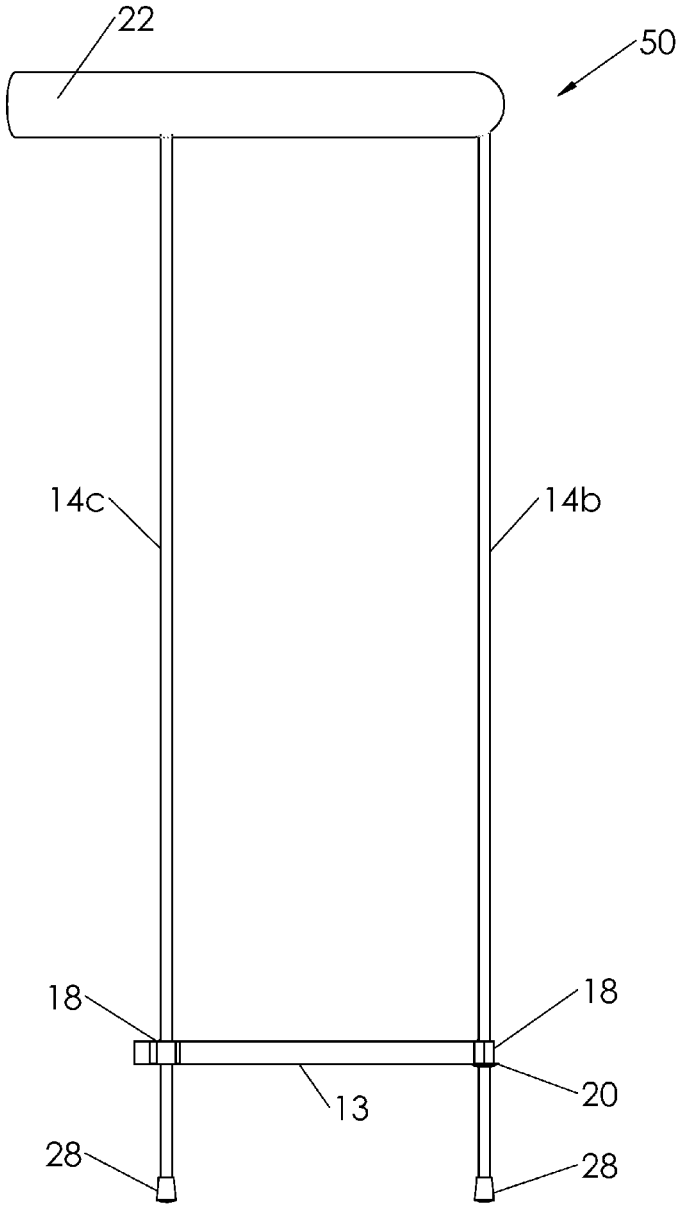
FIG. 9 is a side elevation view of a bag holder according to a third embodiment of the present invention.

Referring next to FIG. 9 there is shown a side elevation view of a bag holder 50 according to a third embodiment of the present invention. The bag holder 50 of the third embodiment is identical to the bag holder 40 of the second embodiment including upper and lower 13 frame members, three vertical support members (only vertical support members 14*b* and 14*c* are visible in FIG. 9) fixed to both the upper and lower frame members using for example fixing members (only the fixing members 18 associated with the lower frame member are visible in FIG. 9) along with an elastomeric pad 22 fixed to the upper frame member. These components are dimensioned, configured and assembled as described above with regards to the first and second embodiments of the invention. However the third embodiment further comprises elastomeric end caps 28 fixed to the lower ends of the vertical support members to impede movement of the bag holder 50 when the bag holder is used on a manmade surface such as concrete, ceramic tile, elastomeric floor coverings, wood flooring and so forth. The elastomeric end caps also serve to impede damaging of elastomeric floor coverings, wood flooring and so forth by the ends of the metal vertical support members. It is understood that a bag holder 10 of the first embodiment, without an elastomeric pad on the upper support member, may be provided with elastomeric end caps in the manner disclosed with regards to this third embodiment.

Figure 11:
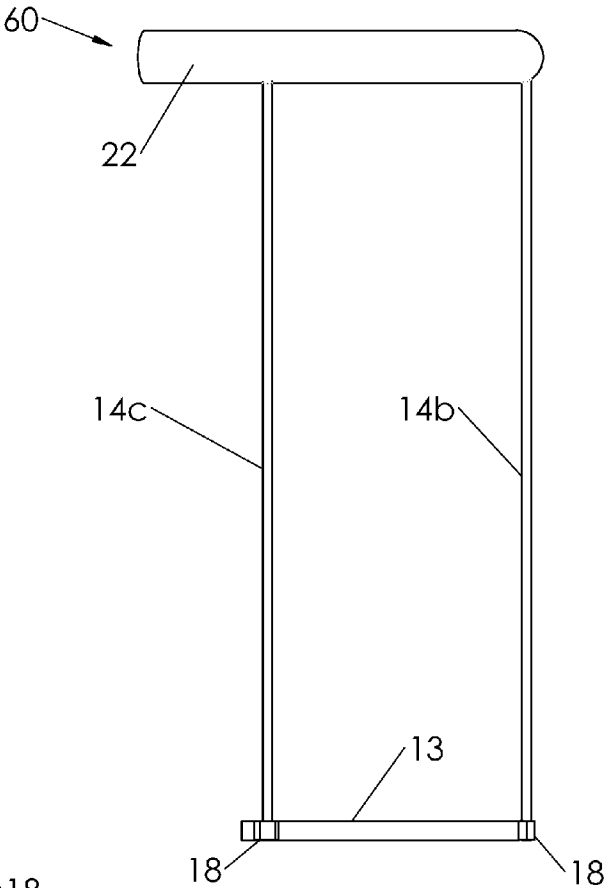
FIG. 11 is a side elevation view of the bag holder of FIG. 10.
Figure 10:
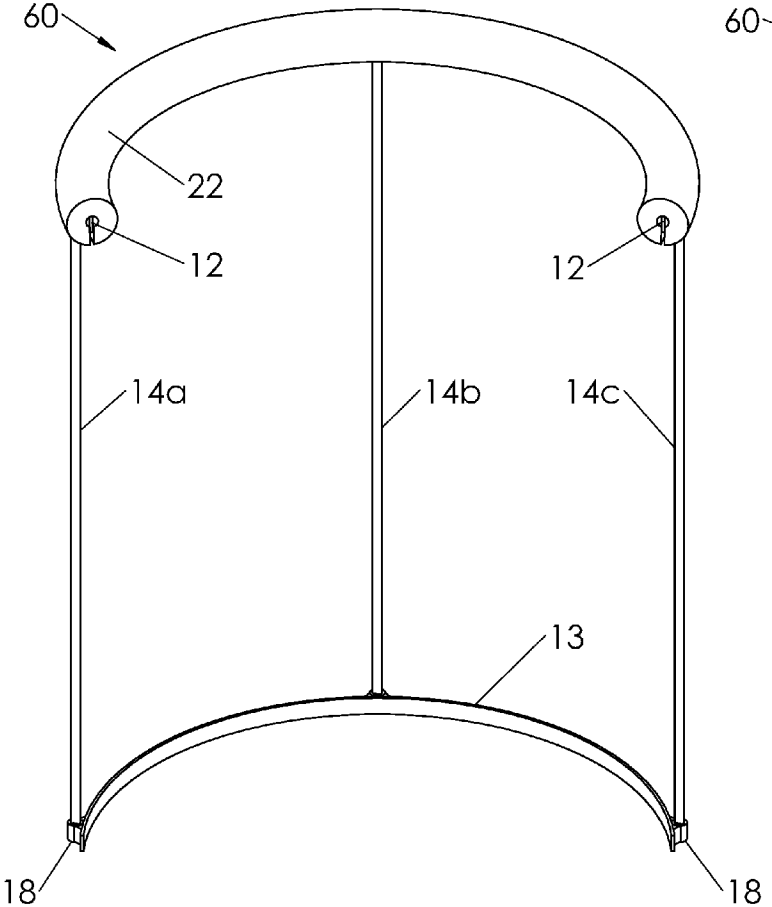
FIG. 10 is a front perspective view of a bag holder according to a fourth embodiment of the present invention.

Referring next to FIGS. 10 and 11 there is shown a bag holder 60 according to a fourth embodiment of the present invention. FIG. 10 is a front perspective view of a bag holder 60 according to a fourth embodiment of the present invention. FIG. 11 is a side elevation view of the bag holder 60 of FIG. 10. The bag holder 60 of the fourth embodiment is identical to the bag holders 50 of the second embodiment including upper 12 and lower 13 frame members, three vertical support members 14*a*, 14*b*, 14*c* fixed to both the upper and lower frame members using for example fixing members (only the fixing members 18 associated with the lower frame member are visible in FIGS. 10 and 11) along with an elastomeric pad 22 fixed to the upper frame member. These components are dimensioned, configured and assembled as described above with regards to the first and second embodiments of the invention with the exception that in this fourth embodiment the lower ends of the vertical support members are not spaced apart from the lower frame member 13. In this embodiment the lower frame member may rest directly on either the earth without being staked to the earth as in the first and second embodiments or the lower frame member may rest directly on a manmade surface such as concrete, ceramic tile, elastomeric floor coverings, wood flooring and so forth. It is understood that a bag holder 60 of the fourth embodiment, without an elastomeric pad on the upper support member, may be provided with regards to this fourth embodiment.

Figure 13:
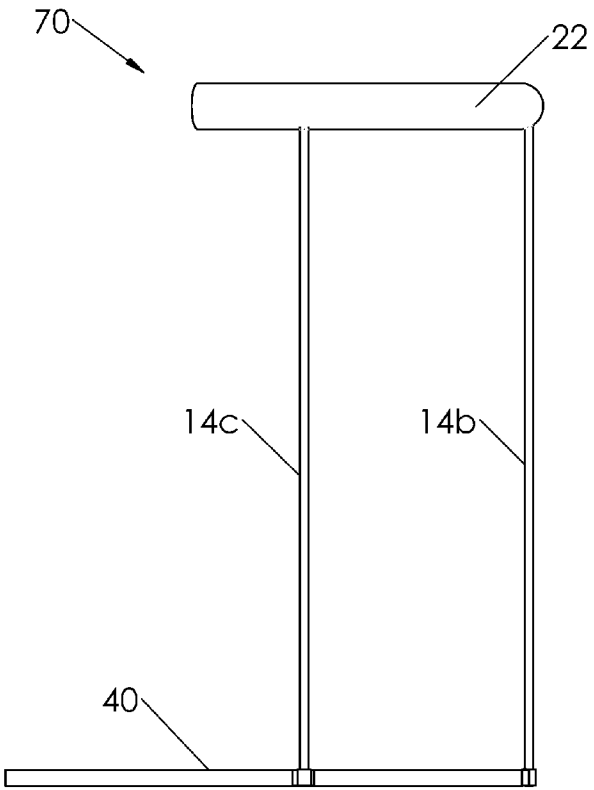
FIG. 13 is a side elevation view of the bag holder of FIG. 12.
Figure 12:
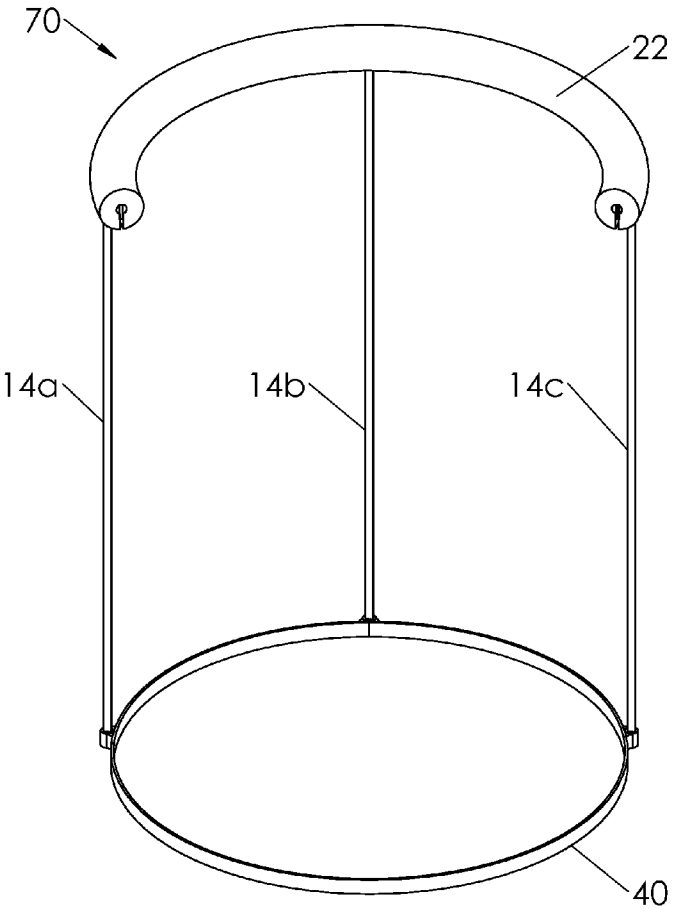
FIG. 12 is a front perspective view of a bag holder according to a fifth embodiment of the present invention.

Referring next to FIGS. 12 and 13 there is shown a bag holder 70 according to a fifth embodiment of the present invention. FIG. 12 is a front perspective view of a bag holder 70 according to a fifth embodiment of the present invention. FIG. 13 is a side elevation view of the bag holder 70 of FIG. 12. The bag holder 70 of the fifth embodiment is identical to the bag holders 60 of the fourth embodiment including upper and lower 13 frame members, three vertical support members 14*a*, 14*b*, 14*c* fixed to both the upper and lower frame members using for example fixing members. The components are dimensioned, configured and assembled as described above with regards to the first and second embodiments of the invention with the exception that the lower frame member 40 is in the shape of a complete closed circle without a gap D2 as in the previously disclosed embodiments. It is understood that while the gap in the upper frame member is essential to the satisfactory functioning of a bag holder of the present invention to facilitate easy removal of a filled plastic bag from the bag holder, the gap in the lower frame member is not so critical with regards to this advantage of the invention. In this embodiment the lower frame member may rest directly on either the earth without being staked to the earth as in the first and second embodiments or the lower frame member may rest directly on a manmade surface such as concrete, ceramic tile, elastomeric floor coverings, wood flooring and so forth. It is understood that a bag holder 70 of the fifth embodiment, without an elastomeric pad on the upper support member, may be provided with regards to this fifth embodiment.

While the invention has been described with reference to certain exemplary embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A bag holder comprising:

(a) a lower frame member having first and second ends and a curved surface that substantially conforms to a first circle's curvature, or at least a portion or segment of the first circle's curvature, the first circle having a first radius;

(b) an upper frame member having first and second ends and a curved surface that substantially conforms to a second circle's curvature, or at least a portion or segment of the second circle's curvature, the second circle having a second radius that is the same as the first radius, the curved surface of the upper frame member having first and second ends with the curved surface of the upper frame member having an arc with ends at the first and second ends of curved surface of the upper frame member that is more than 180 degrees of the second circle's curvature; and (c) first, second and third vertical support members, each of the vertical support members comprising a one piece straight member that is fixed directly or indirectly to the radially outermost curved surfaces of both the upper and lower frame members by a means for attachment that is permanently fixed to the radially outermost curved surfaces of the upper and lower frame members with the upper and lower frame members spaced apart from one another, the second vertical support member being located substantially equidistant from the first and second vertical support members as measured along the curved surfaces of both the lower and upper frame members, the curved surface of the lower frame member having an arc with ends at the ends of the lower frame member that is not more than 180 degrees of the first circle's curvature, and the curved surface of the upper frame member having an arc with ends at the ends of the upper frame member that is more than 180 degrees of the second circle's curvature, each of the vertical supports being straight and having a first end vertically aligned with the upper frame member and a second end that is spaced apart from and located below the lower frame member.

2. The bag holder of claim 1 wherein the curved surface of the lower frame member has an arc with ends at the first and second ends of the curved surface of the lower frame member that is about 172 degrees of the first circle's curvature, and the radially outermost curved surface has an arc with ends at the first and second ends of the radially outer curved surface of the upper frame member is about 210 degrees of the second circle's curvature.

3. The bag holder of claim 1 wherein the second end of each of the vertical supports is spaced below the lower frame member a distance UP to about thirteen percent of the overall length of the vertical support.

4. The bag holder of claim 2 wherein the second end of each of the vertical supports is spaced below the lower frame member a distance UP to about thirteen percent of the overall length of the vertical support.

5. The bag holder of claim 1 further comprising an elastomeric pad that is fixed to the upper frame member.

6. The bag holder of claim 2 further comprising an elastomeric pad that is fixed to the upper frame member.

7. The bag holder of claim 3 further comprising an elastomeric pad that is fixed to the upper frame member.

8. The bag holder of claim 4 further comprising an elastomeric pad that is fixed to the upper frame member.

9. The bag holder of claim 5 further comprising an elastomeric pad that is fixed to the upper frame member.

10. The bag holder of claim 3 wherein the second ends of each of the vertical supports has an elastomeric end cap fixed thereto.

11. The bag holder of claim 4 wherein the second ends of each of the vertical supports has an elastomeric end cap fixed thereto.

12. A bag holder comprising:

(a) a lower frame member having first and second ends and a curved surface that substantially conforms to a first circle's curvature, or at least a portion or segment of the first circle's curvature, the first circle having a first radius, the distance between the first and second ends of the lower frame member measured along a straight line being a first distance;

(b) an upper frame member having first and second ends and a curved surface that substantially conforms to a second circle's curvature, or at least a portion or segment of the second circle's curvature, the second circle having a second radius that is the same as the first radius, the distance between the first and second ends of the upper frame member measured along a straight line being a second distance, the first distance being greater than the second distance; and (c) first, second and third vertical support members, each of the vertical support members comprising a one piece straight member that is fixed to the radially outer curved surfaces of both the upper and lower frame members by a means for attachment that is permanently fixed to the radially outermost curved surfaces of the upper and lower frame members with the upper and lower frame members spaced apart from one another, the second vertical support member being located substantially equidistant from the first and second vertical support members as measured along the curved surfaces of both the lower and upper frame members, the curved surface of the lower frame member having an arc with ends at the ends of the lower frame member that is not more than 180 degrees of the first circle's curvature, and the curved surface of the upper frame member having an arc with ends at the ends of the upper frame member that is more than 180 degrees of the second circle's curvature, each of the vertical supports is straight and has a first end vertically aligned with the upper frame member and a second end that is spaced apart from and below the lower frame member.

13. The bag holder of claim 12 further comprising an elastomeric pad that extends along the upper frame member continuously between the first and second ends of the curved surface of the upper frame member and wraps around the upper frame member.

14. The bag holder of claim 12 wherein the curved surface of the lower frame member has an arc with ends at the first and second ends of the curved surface of the lower frame member that is about 172 degrees of the first circle's curvature, and the curved surface of the upper frame member has an arc with ends at the first and second ends of the radially outer curved surface of the upper frame member is about 210 degrees of the second circle's curvature.

15. The bag holder of claim 12 wherein the curved surface of the upper frame member has an arc with ends at the first and second ends of curved surface of the upper frame member that is more than 180 degrees of the second circle's curvature, and the curved surface of the lower frame member has an arc with ends at the first and second ends of the curved surface of the lower frame member that is fewer degrees of the first circle's curvature than the arc of the upper frame member is of the second circle's curvature.

16. The bag holder of claim 14 wherein the curved surface of the upper frame member has an arc with ends at the first and second ends of curved surface of the upper frame member that is more than 180 degrees of the second circle's curvature, and the curved surface of the lower frame member has an arc with ends at the first and second ends of the curved surface of the lower frame member that is fewer degrees of the first circle's curvature than the arc of the upper frame member is of the second circle's curvature.

17. The bag holder of claim 12 wherein the second end of each of the vertical supports is spaced below the lower frame member a distance up to about thirteen percent of the overall length of the vertical support.

* * * * *